US011434908B2

(12) United States Patent
Park et al.

(10) Patent No.: US 11,434,908 B2
(45) Date of Patent: Sep. 6, 2022

(54) COMPRESSOR HAVING LUBRICATION STRUCTURE FOR THRUST SURFACE

(71) Applicant: LG ELECTRONICS INC., Seoul (KR)

(72) Inventors: Sang Baek Park, Seoul (KR); Jungsun Choi, Seoul (KR); Cheol Hwan Kim, Seoul (KR); Byeongchul Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 89 days.

(21) Appl. No.: 16/914,726

(22) Filed: Jun. 29, 2020

(65) Prior Publication Data

US 2020/0340477 A1 Oct. 29, 2020

Related U.S. Application Data

(63) Continuation of application No. 15/830,184, filed on Dec. 4, 2017, now Pat. No. 10,697,455.

(30) Foreign Application Priority Data

Jun. 22, 2017 (KR) ..... 10-2017-0079174

(51) Int. Cl.
*F01C 1/02* (2006.01)
*F03C 2/00* (2006.01)
(Continued)

(52) U.S. Cl.
CPC ..... *F04C 18/0215* (2013.01); *F01C 21/003* (2013.01); *F04C 18/0269* (2013.01);
(Continued)

(58) Field of Classification Search
CPC ..... F04C 18/0215; F04C 18/0246; F04C 18/0261; F04C 18/0269; F04C 18/0292;
(Continued)

(56) References Cited

U.S. PATENT DOCUMENTS 4,596,520 A 6/1986 Arata et al.
4,626,180 A 12/1986 Tagawa
(Continued)

FOREIGN PATENT DOCUMENTS

EP 0 913 581 5/1999
EP 1 526 283 4/2005
(Continued)

OTHER PUBLICATIONS

Korean Office Action issued in Application No. 10-2017-0079174 dated Jul. 12, 2021.
(Continued)

*Primary Examiner* — Theresa Trieu
(74) *Attorney, Agent, or Firm* — Ked & Associates

(57) ABSTRACT

A compressor is provided which is configured to allow lubrication of a thrust surface through an oil groove formed in a thrust surface of a fixed scroll. Also, a scroll compressor is provided which smoothly supplies oil to a thrust surface of a fixed scroll by including a fixed scroll having an oil groove formed in the thrust surface of a fixed scroll sidewall, and allows an injection pressure acting on an orbiting scroll in an upward direction to be added by supplying the oil guided to the oil groove to the thrust surface of the fixed scroll such that an overturn moment generated in the orbiting scroll may be offset.

16 Claims, 7 Drawing Sheets

(51) Int. Cl.

| | |
|---|---|
| ***F03C 4/00*** | (2006.01) |
| ***F04C 18/00*** | (2006.01) |
| ***F04C 2/00*** | (2006.01) |
| ***F04C 18/02*** | (2006.01) |
| ***F01C 21/00*** | (2006.01) |
| ***F04C 29/12*** | (2006.01) |
| *F04C 29/02* | (2006.01) |
| *F04C 23/00* | (2006.01) |

(52) U.S. Cl.
CPC ..... *F04C 18/0292* (2013.01); *F04C 29/12* (2013.01); *F04C 18/0261* (2013.01); *F04C 23/008* (2013.01); *F04C 29/023* (2013.01); *F04C 2240/603* (2013.01)

(58) Field of Classification Search
CPC .... F04C 23/008; F04C 27/005; F04C 29/023; F04C 29/12; F04C 2210/26; F04C 2240/30; F04C 2240/60; F04C 2240/603; F01C 21/003
See application file for complete search history.

(56) References Cited

U.S. PATENT DOCUMENTS

| | | | |
|---|---|---|---|
| 4,768,936 | A | 9/1988 | Etemad |
| 4,898,521 | A | 2/1990 | Sakurai |
| 5,803,722 | A | 9/1998 | Noboru |
| 6,030,192 | A | 2/2000 | Hill |
| 6,273,691 | B1 | 8/2001 | Morimoto et al. |
| 7,614,860 | B2 | 11/2009 | Yano |
| 9,353,747 | B2 | 5/2016 | Ito |
| 9,850,904 | B2 | 12/2017 | Toyama |
| 2009/0098000 | A1 | 4/2009 | Ignatiev |
| 2010/0122549 | A1 | 5/2010 | Cho |
| 2012/0148434 | A1 | 6/2012 | Takabe et al. |
| 2013/0078131 | A1 | 3/2013 | Ahn et al. |
| 2013/0343941 | A1 | 12/2013 | Kim et al. |
| 2014/0140877 | A1 | 5/2014 | Ni |
| 2014/0234148 | A1 | 8/2014 | Takeda |
| 2016/0040671 | A1 | 2/2016 | Choi et al. |
| 2016/0040673 | A1 | 2/2016 | Lee et al. |
| 2016/0047378 | A1 | 2/2016 | Choi et al. |
| 2016/0053759 | A1 | 2/2016 | Choi et al. |
| 2016/0108917 | A1 | 4/2016 | Bonnefoi |
| 2016/0341249 | A1 | 11/2016 | Yang |

FOREIGN PATENT DOCUMENTS

| | | |
|---|---|---|
| EP | 2 369 182 | 9/2011 |
| EP | 2 574 791 | 4/2013 |
| EP | 2 690 287 | 1/2014 |
| EP | 3 401 543 | 11/2019 |
| JP | S 62-178791 | 8/1987 |
| JP | H 03-202682 | 9/1991 |
| JP | H 07-054784 | 2/1995 |
| JP | H 08-303364 | 11/1996 |
| JP | H 08-303365 | 11/1996 |
| JP | H 10-169574 | 6/1998 |
| JP | 2009-036069 | 2/2009 |
| JP | 2010-180704 | 8/2010 |
| JP | 5 199951 | 5/2013 |
| KR | 10-2011-0064663 | 6/2011 |
| KR | 10-1059880 | 8/2011 |
| KR | 10-2013-0034536 | 4/2013 |
| KR | 10-2016-0017539 | 2/2016 |
| WO | WO 97/17543 | 5/1997 |
| WO | WO 2014/198215 | 12/2014 |
| WO | WO 2015/085823 | 6/2015 |

OTHER PUBLICATIONS

U.S. Notice of Allowance issued in U.S. Appl. No. 16/962,088 dated Mar. 31, 2021.
European Office Action issued in Application No. 17 205 582.4 dated Dec. 10, 2020.
U.S. Appl. No. 16/914,726, filed Jun. 29, 2020.
U.S. Appl. No. 16/692,112, filed Nov. 22, 2019.
European Search Report dated May 4, 2018 issued in Application No. 17204354.9.
European Search Report dated May 17, 2018 issued in Application No. 17205582.4.
Korean Office Action dated Jul. 16, 2018 issued in Application No. 10-2017-6075041.
European Search Report dated Apr. 26, 2018 issued in Application No. 17199214.2.
Korean Office Action dated Aug. 20, 2018.
European Search Report dated Sep. 7, 2018.
United States Office Action dated Oct. 31, 2019 issued in co-pending related U.S. Appl. No. 15/830,161.
U.S. Office Action dated Nov. 14, 2019 issued in U.S. Appl. No. 15/830,290.
United States Office Action dated Jan. 14, 2020 issued in co-pending related U.S. Appl. No. 15/830,135.
U.S. Office Action dated Jan. 28, 2020 issued in co-pending related U.S. Appl. No. 15/830,222.
European Office Action dated Feb. 6, 2020.
U.S. Office Action dated Apr. 30, 2020 issued in U.S. Appl. No. 15/830,290.
U.S. Office Action dated Nov. 1, 2019 issued in U.S. Appl. No. 15/830,184.
U.S. Notice of Allowance dated Mar. 31, 2020 issued in U.S. Appl. No. 15/830,184.
U.S. Notice of Allowance issued in U.S. Appl. No. 15/830,222 dated Jun. 18, 2020.
U.S. Appl. No. 16/692,088, filed Nov. 22, 2019.
U.S. Office Action dated May 10, 2021 issued in co-pending related U.S. Appl. No. 16/692,112.
U.S. Office Action dated Nov. 19, 2020 issued in U.S. Appl. No. 16/692,088.

COMPRESSOR HAVING LUBRICATION STRUCTURE FOR THRUST SURFACE

CROSS-REFERENCE TO RELATED APPLICATIONS

This application is a Continuation Application of prior U.S. patent application Ser. No. 15/830,184 filed on Dec. 4, 2017, which claims priority under 35 U.S.C. § 119 to Korean Application No. 2017-0079174, filed in Korea on Jun. 22, 2017, whose entire disclosures are hereby incorporated by reference.

BACKGROUND

1. Field

A compressor in which a lubrication performance of a thrust surface is secured through an oil groove formed in a thrust surface of a fixed scroll.

2. Background

Generally, a compressor is applied to a vapor compression type refrigeration cycle (hereinafter, referred to as a "refrigeration cycle") used for a refrigerator, or an air conditioner, for example. Compressors may be classified into reciprocating compressors, rotary compressors, and scroll compressors, for example, according to a method of compressing a refrigerant.

The scroll compressor among the above-described compressors is a compressor which performs an orbiting movement by engaging an orbiting scroll with a fixed scroll fixed inside of a sealed container so that a compression chamber is formed between a fixed wrap of the fixed scroll and an orbiting wrap of the orbiting scroll. The scroll compressor is widely used for compressing a refrigerant in an air conditioner, for example, because the scroll compressor can obtain a relatively higher compression ratio than the other types of compressors and can obtain a stable torque because suction, compression, and discharge strokes of the refrigerant are smooth and continuous.

Such scroll compressors may be classified into upper compression type compressors or lower compression type compressors according to a location of a drive motor and a compression component. The compression component is located at a higher level than the drive motor in the upper compression type compressor, and the compression component is located at a lower level than the drive motor in the lower compression type compressor.

The lower compression scroll compressor is capable of relatively uniformly supplying oil because a distance between an oil storage chamber and the compression component is short, but supplying oil therewith can be structurally difficult. More particularly, mechanical loss is increased because oil cannot be smoothly supplied to a thrust surface of the fixed scroll such that wear of the fixed scroll or the orbiting scroll is promoted. Further, a compression efficiency of the lower compression scroll compressor is lowered because an overturn moment is generated by a repulsive force of the refrigerant, that is, a gas pressure, generated during compression, and the orbiting scroll is inclined or shaken in an axial direction.

BRIEF DESCRIPTION OF THE DRAWINGS

Embodiments will be described in detail with reference to the following drawings in which like reference numerals refer to like elements, and wherein.

DETAILED DESCRIPTION

Figure 1:
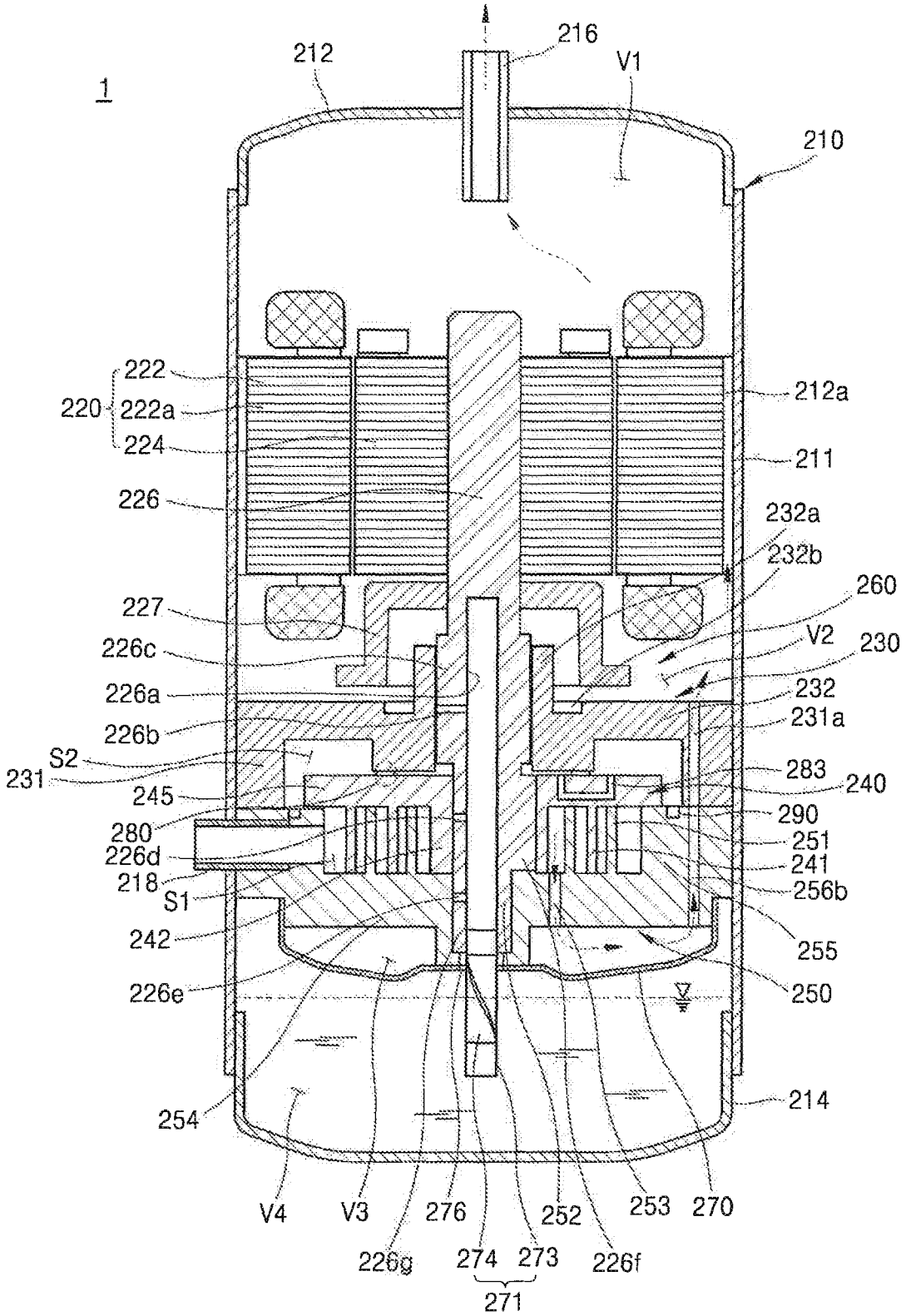
FIG. 1 is a cross-sectional view of a scroll compressor according to an embodiment.

Hereinafter, embodiments will be described in detail with reference to the accompanying drawings. Wherever possible, like or similar reference numerals in the drawings have been used to indicate like or similar elements, and repetitive disclosure has been omitted.

Hereinafter, a scroll compressor according to an embodiment will be described.

Figure 2:
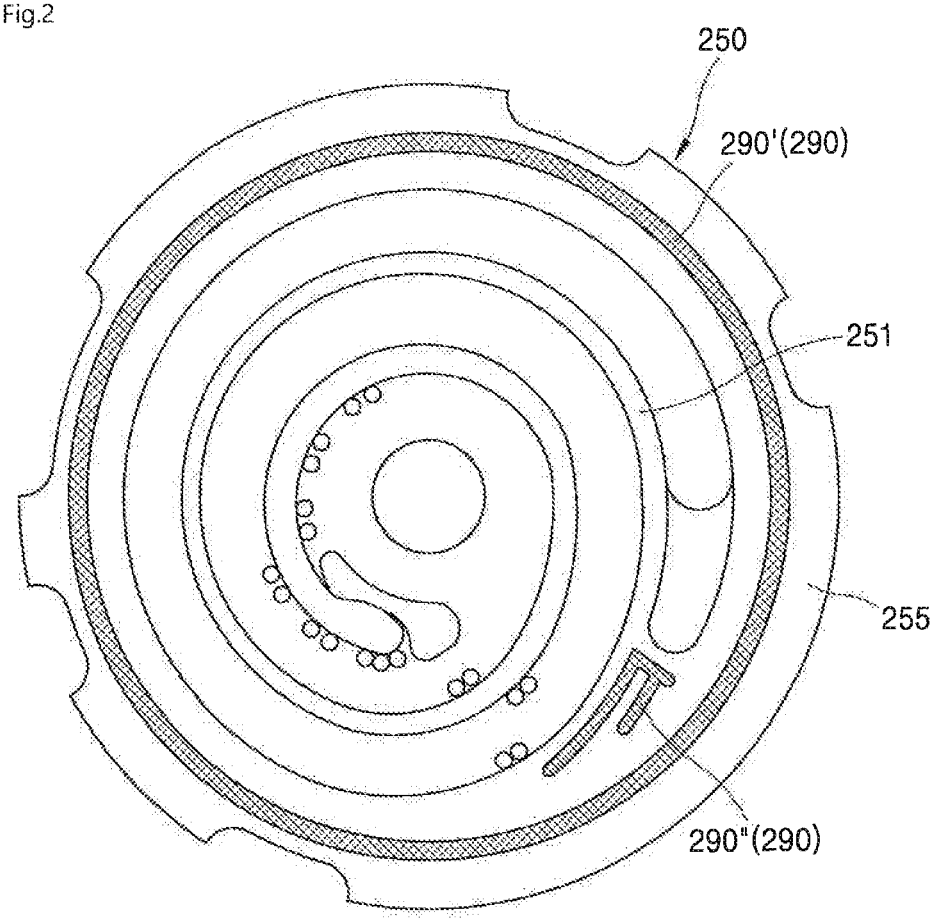
FIG. 2 is a plan view of a fixed scroll of the scroll compressor in FIG. 1.
Figure 3:
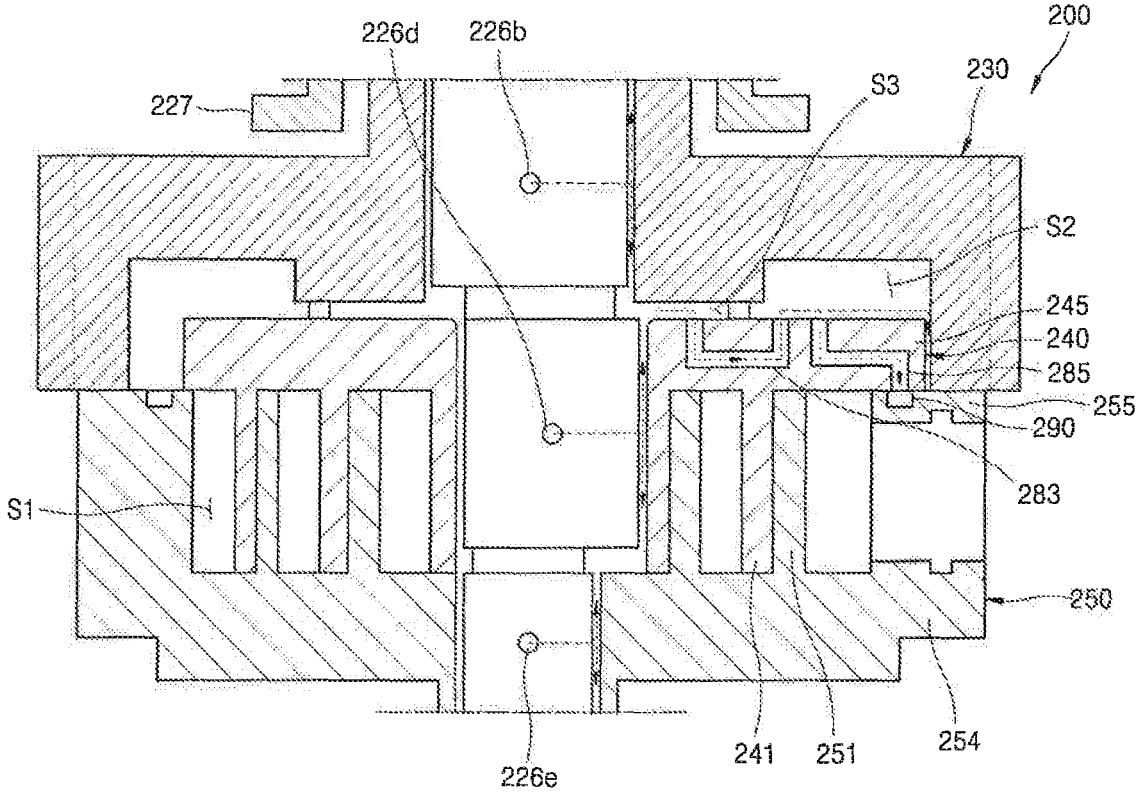
FIG. 3 is a schematic partial cross-sectional view for describing a flow of oil in the scroll compressor in FIG. 1.

FIG. 1 is a cross-sectional view of a scroll compressor according to an embodiment. FIG. 2 is a plan view of a fixed scroll of the scroll compressor in FIG. 1. FIG. 3 is a schematic partial cross-sectional view for describing a flow of oil in the scroll compressor in FIG. 1.

Referring to FIGS. 1 and 2, a scroll compressor 1 according to an embodiment may include a casing 210 having an inner space, a drive motor 220 provided in an upper portion of the inner space, a compression part or device 200 disposed under the drive motor 220, and a rotary shaft 226 configured to transmit a drive force of the drive motor 220 to the compression device 200. The inner space of the casing 210 may be divided into a first space V1, which may be provided at an upper side of the drive motor 220, a second space V2 between the drive motor 220 and the compression device 200, a third space V3 partitioned by a discharge cover 270, and an oil storage chamber V4, which may be provided under the compression device 200.

The casing 210, for example, may have a cylindrical shape, and thus, the casing 210 may include a cylindrical shell 211. An upper shell or cover 212 may be installed or provided on or at an upper portion of the cylindrical shell 211, and a lower shell or cover 214 may be installed or provided on or at a lower portion of the cylindrical shell 211. The upper and lower shells 212 and 214, for example, may be coupled to the cylindrical shell 211 by welding, and may form an inner space thereof.

A refrigerant discharge pipe 216 may be installed or provided in the upper shell 212. The refrigerant discharge pipe 216 may form a path through which a compressed refrigerant discharged from the compression device 200 into the second space V2 and the first space V1 may be discharged to the outside. An oil separator (not shown) configured to separate oil mixed with the discharged refrigerant may be connected to the refrigerant discharge pipe 216.

The lower shell 214 may form the oil storage chamber V4 capable of storing oil therein. The oil storage chamber V4 may serve as an oil chamber from which the oil may be supplied to the compression chamber 200 so that the compressor may be smoothly operated.

A refrigerant suction pipe 218, which may form a path through which a refrigerant to be compressed may be introduced, may be installed in a side surface of the cylindrical shell 211. The refrigerant suction pipe 218 may be installed or provided to penetrate up to a compression chamber S1 along a side surface of a fixed scroll 250.

The drive motor 220 may be installed or provided in or at an upper portion inside of the casing 210. More specifically, the drive motor 220 may include a stator 222 and a rotor 224.

The stator 222, for example, may have a cylindrical shape, and may be fixed to the casing 210. A plurality of slots (not shown) may be formed in an inner circumferential surface of the stator 222 in a circumferential direction, and a coil 222*a* may be wound on the stator 222. Also, a refrigerant flow groove 212*a* may be cut in a D-cut shape and may be formed in an outer circumferential surface of the stator 222 so that a refrigerant or oil discharged from the compression device 200 may pass through the refrigerant flow groove 212*a*.

The rotor 224 may be coupled to an inside of the stator 222 and may generate rotational power. Also, the rotary shaft 226 may be press-fitted into a center of the rotor 224 so that the rotary shaft 226 may rotate with the rotor 224. The rotational power generated by the power rotor 224 may be transmitted to the compression device 200 through the rotary shaft 226.

The compression device 200 may include a main frame 230, the fixed scroll 250, an orbiting scroll 240, and the discharge cover 270. Although not shown in the drawings, the compression device 200 may be further provided with an Oldham's ring. The Oldham's ring may be installed between the orbiting scroll 240 and the main frame 230. The Oldham's ring may prevent rotation of the orbiting scroll 240 and allow an orbiting movement of the orbiting scroll 240 on the fixed scroll 250.

The main frame 230 may be provided under the drive motor 220 and may form an upper portion of the compression device 200. A frame end plate 232 (hereinafter, a "first end plate") having a roughly circular shape, a frame bearing section 232*a* (hereinafter, a "first bearing section") provided at a center of the first end plate 232 and with the rotary shaft 226 passing therethrough, and a frame sidewall 231 (hereinafter, "a first sidewall") configured to protrude downward from an outer circumferential portion of the first end plate 232 may be provided on the main frame 230. An outer circumferential portion of the first sidewall 231 may be in contact with an inner circumferential surface of the cylindrical shell 211, and a lower end of the first sidewall 231 may be in contact with an upper end of a fixed scroll sidewall 255, which will be described hereinafter.

A frame discharge hole 231*a* (hereinafter, a "first discharge hole") configured to pass through an inside of the first sidewall 231 in an axial direction and form a refrigerant path may be provided in the first sidewall 231. An entrance of the first discharge hole 231*a* may be connected to an exit of a discharge hole 256*b* of the fixed scroll 250, which will be described hereinafter, and an exit thereof may be connected to the second space V2.

The first bearing section 232*a* may protrude from an upper surface of the first end plate 232 toward the drive motor 220. A first bearing portion may be formed in the first bearing section 232*a* so that a main bearing portion 226*c* of the rotary shaft 226, which will be described hereinafter, may pass through and be supported. That is, the bearing section 232*a*, in which the main bearing portion 226*c* of the rotary shaft 226 configured to form the first bearing portion is rotatably inserted into a center of the main frame 230 and supported by the main frame 230, may be formed to pass in the axial direction.

An oil pocket 232*b* configured to collect oil discharged between the first bearing section 232*a* and the rotary shaft 226 may be formed in an upper surface of the first end plate 232. More specifically, the oil pocket 232*b* may be concavely formed in the upper surface of the first end plate 232 and may be formed in a ring shape along an outer circumferential surface of the first bearing section 232*a*.

A back pressure chamber S2 may be formed on a lower surface of the main frame 230 to form a space with the fixed scroll 250 and the orbiting scroll 240 so that the orbiting scroll 240 may be supported by a pressure of the space. For example, the back pressure chamber S2 may be a medium pressure area, that is, a "medium pressure chamber", and a first oil supply path 226*a* provided in the rotary shaft 226 may have a higher pressure than the back pressure chamber S2. Also, a space surrounded by the rotary shaft 226, the main frame 230, and the orbiting scroll 240 may be a high pressure area S3 (see FIG. 3). That is, the high pressure area S3 (see FIG. 3) and the medium pressure area may be formed between the main frame 230 and the orbiting scroll 240. Each of the high pressure area S3 (see FIG. 3) and the medium pressure area S2 may be separated from the rotary shaft 226 in a radial direction.

A back pressure seal 280 may be provided between the main frame 230 and the orbiting scroll 240 to divide the high pressure area S3 (see FIG. 3) and the medium pressure area S2. The back pressure seal 280, for example, may function as a sealing member or seal.

The main frame 230 may be coupled to the fixed scroll 250 to form a space in which the orbiting scroll 240 may be rotatably installed or provided. That is, such a structure may be a structure configured to cover the rotary shaft 226 so that the rotational power may be transmitted to the compression device 200 through the rotary shaft 226.

The fixed scroll 250 configured to form a first scroll may be coupled to a lower surface of the main frame 230. More specifically, the fixed scroll 250 may be provided under the main frame 230.

The fixed scroll 250 may be provided with an end plate 254 of the fixed scroll 250 (a "second end plate") having a roughly circular shape, the fixed scroll sidewall 255 (hereinafter, a "second sidewall") configured to protrude upward from an outer circumferential portion of the second end plate 254, a fixed wrap 251 configured to protrude from an upper surface of the second end plate 254 and be coupled with, that is, engaged with, an orbiting wrap 241 of the orbiting scroll 240, which will be described hereinafter, to form the compression chamber S1, and a bearing section 252 of the fixed scroll 250 (hereinafter, a "second bearing section") formed at a center of a rear surface of the second end plate 254 and with the rotary shaft 226 passing therethrough.

A discharge path 253 configured to guide a compressed refrigerant from the compression chamber S1 to an inner space of the discharge cover 270 may be formed in the second end plate 254. A location of the discharge path 253 may be arbitrarily set in consideration of a desired discharge pressure, for example.

As the discharge path 253 is formed toward the lower shell 214, the discharge cover 270 for accommodating a discharged refrigerant and guiding the corresponding refrigerant to the discharge hole 256*b* of the fixed scroll 250, which will be described hereinafter, so as not to be mixed with oil may be coupled to a lower surface of the fixed scroll 250. The discharge cover 270 may be sealed from and coupled to the lower surface of the fixed scroll 250 to separate a discharge path of refrigerant from the oil storage chamber V4.

A through hole 276 may be formed in the discharge cover 270 so that an oil feeder 271 coupled to a bearing portion 226*g* of the rotary shaft 226 configured to form a second bearing portion and extend into the oil storage chamber V4 of the casing 210 may pass through the through hole 276.

An outer circumferential portion of the second sidewall 255 may be in contact with an inner circumferential surface of the cylindrical shell 211. An upper end of the second sidewall 255 may be in contact with a lower end of the first sidewall 231.

An oil groove 290 may be formed in a thrust surface of the second sidewall 255. More specifically, an upper surface of the second sidewall 255 may include the thrust surface, and the oil groove 290, for example, may be a groove in which oil may be accommodated. The thrust surface may refer to a surface of the upper surface of the second sidewall 255 which is in contact with a lower surface of an outer circumferential portion of an orbiting scroll end plate 245, which will be described hereinafter.

The oil groove 290 may include a first oil groove 290' formed in the thrust surface along an outer circumferential surface of the second sidewall 255 and a second oil groove 290" formed in the thrust surface between the first oil groove 290' and the fixed wrap 251. The first oil groove 290', for example, may be a ring shaped oil groove. Also, the second oil groove 290" may be an auxiliary oil groove formed in the thrust surface adjacent to a starting point of the fixed wrap 251.

For example, the starting point of the fixed wrap 251 may be a point further away from the rotary shaft 226 in the radial direction than an ending point of the fixed wrap 251. Also, although not shown in the drawings, the first oil groove 290' may include a plurality of ring shaped oil grooves, and the second oil groove 290" may include a plurality of auxiliary oil grooves separated from each other.

Further, when the first oil grooves 290' includes the plurality of ring shaped oil grooves and the second oil grooves 290" includes the plurality of auxiliary oil grooves, the plurality of ring shaped oil grooves and the plurality of auxiliary oil grooves may be alternatively formed in the thrust surface of the second sidewall 255 so that the auxiliary oil grooves are disposed one by one between the ring shaped oil grooves. Also, when the first oil grooves 290' includes the plurality of ring shaped oil grooves and the second oil grooves 290" includes the plurality of auxiliary oil grooves, the ring shaped oil grooves may be continuously formed in the thrust surface of the second sidewall 255, and the auxiliary oil grooves may be formed in only the thrust surface adjacent to the starting point of the fixed wrap 251. However, in this embodiment, an example in which one first oil groove 290' and one second oil groove 290" are formed will be described for the sake of convenience of the description.

Oil guided upward through the first oil supply path 226*a* provided in the rotary shaft 226 may pass through the main frame 230 and the orbiting scroll 240 and may be guided to the oil groove 290. That is, the oil guided upward through the first oil supply path 226*a* may sequentially pass through the high pressure area S3 (see FIG. 3) and the medium pressure area S2 formed between the main frame 230 and the orbiting scroll 240 and may be guided to the oil groove 290. The oil guided to the oil groove 290 may be supplied to the thrust surface and may prevent wear of the thrust surface.

The discharge hole 256*b* of the fixed scroll 250 (hereinafter, a "second discharge hole") configured to pass through an inside of the second sidewall 255 in the axial direction and form the refrigerant path with the first discharge hole 231*a* may be provided in the second sidewall 255. The second discharge hole 256*b* may be formed to correspond to the first discharge hole 231*a*, an entrance thereof may be connected to the inner space of the discharge cover 270, and an exit thereof may be connected to the entrance of the first discharge hole 231*a*.

The second discharge hole 256*b* and the first discharge hole 231*a* may connect the second space V2 and the third space V3 so that a refrigerant discharged into the inner space of the discharge cover 270 from the compression chamber S1 may be guided to the second space V2. Further, the refrigerant suction pipe 218 may be installed or provided in the second sidewall 255 to be connected to a suction side of the compression chamber S1. The refrigerant suction pipe 218 may be installed or provided to be separated from the second discharge hole 256*b*.

The second bearing section 252 may protrude from a lower surface of the second end plate 254 toward the oil storage chamber V4. The second bearing portion may be provided in the second bearing section 252 so that the sub-bearing portion 226*g* of the rotary shaft 226 may be inserted thereinto and supported. The second bearing section 252 may be bent toward a center of the rotary shaft 266 so that a lower end thereof may support a lower end of the sub-bearing portion 226*g* of the rotary shaft 226 and form a thrust bearing surface.

The orbiting scroll 240 configured to form a second scroll may be installed between the main frame 230 and the fixed scroll 250. More specifically, the orbiting scroll 240 may form a pair of compression chambers S1 between the fixed scroll 250 and the orbiting scroll 240 while being coupled to the rotary shaft 226 and performing an orbiting movement. The orbiting scroll 240 may include the orbiting scroll end plate 245 (hereinafter, a "third end plate") having a roughly circular shape, the orbiting wrap 241 configured to protrude from the third end plate 245 and engaged with the fixed wrap 251, and a rotary shaft coupler 242 provided at a center of the third end plate 245 and rotatably coupled to an eccentric part 226*f* of the rotary shaft 226.

In the orbiting scroll 240, an outer circumferential portion of the third end plate 245 may be located at the upper end of second sidewall 255 and a lower end of the orbiting wrap 241 may be in close contact with the upper surface of the second end plate 254 such that the orbiting scroll 240 may be supported by the fixed scroll 250. A second oil supply path 283 configured to guide oil, which is guided to the high pressure area S3 (see FIG. 3) through the first oil supply path 226*a* of the rotary shaft 226, which will be described hereinafter, to the medium pressure area S2 may be provided in the third end plate 245.

For example, the oil flowing in the first oil supply path 226*a* may be guide to the high pressure area S3 (see FIG. 3) through oil holes 226*b*, 226*d*, and 226*e* configured to pass from the first oil supply path 226*a* to an outer circumferential surface of the first oil supply path 226*a*. Also, as the oil is in a relatively high pressure state in comparison to a pressure in the medium pressure area S2, the oil may be smoothly supplied to the medium pressure area S2 through the second oil supply path 283.

Further, a third oil supply path 285 (see FIG. 3) configured to guide the oil guided to the medium pressure area S2 to the oil groove 290 may be provided in the third end plate 245. Although the third oil supply path 285 (see FIG. 3) may not be provided in the third end plate 245, an example in which the third oil supply path 285 (see FIG. 3) is provided in the third end plate 245 will be described in this embodiment for the sake of convenience of the description.

An outer circumferential portion of the rotary shaft coupler 242 may be connected to the orbiting wrap 241 and function to form the compression chamber S1 with the fixed wrap 251 during a compressing process. Although the fixed wrap 251 and the orbiting wrap 241 may be formed in an involute shape, the fixed wrap 251 and the orbiting wrap 241 may be formed in various shapes other than the involute shape. The involute shape means a curved line corresponding to a trajectory drawn by an end of a thread when the thread is wound around a base circle having an arbitrary radius and released.

The eccentric portion 226*f* of the rotary shaft 226 may be inserted into the rotary shaft coupler 242. The eccentric portion 226*f* inserted into the rotary shaft coupler 242 may overlap the orbiting wrap 241 or the fixed wrap 251 in the radial direction of the compressor. The term "radial direction" may refer to a direction, that is, a lateral direction, perpendicular to the axial direction, that is, a longitudinal direction, and more specifically, the radial direction may refer to a direction from an outside of the rotary shaft to an inside thereof.

As described above, when the eccentric portion 226*f* of the rotary shaft 226 passes through the orbiting scroll end plate 245 and overlaps the orbiting wrap 241 in the radial direction, a repulsive force, that is, gas pressure, and a compressive force, that is, back pressure of the refrigerant may be applied to a same plane on the basis of the orbiting scroll end plate 245 and be partially offset. However, an overturn moment is generated in the orbiting scroll 240 by the gas pressure so that the orbiting scroll 240 may be shaken or inclined.

However, in this embodiment, an injection pressure may be added by supplying the oil guided to the oil groove 290 to the thrust surface of the fixed scroll 250. As the overturn moment due to the gas pressure is offset by the added injection pressure, the orbiting scroll 240 may be prevented from being shaken in the axial direction or being inclined.

The above will be described hereinafter.

The rotary shaft 226 may be coupled to the drive motor 220 and may be provided with the first oil supply path 226*a* to guide oil accommodated in the oil storage chamber V4 of the casing 210 upward. More specifically, an upper portion of the rotary shaft 226 may be press-fitted into and coupled to the center of the rotor 224, and a lower portion thereof may be coupled to and supported in the radial direction by the compression device 200.

Accordingly, the rotary shaft 226 may transmit a rotational force of the drive motor 220 to the orbiting scroll 240 of the compression device 200. In addition, the orbiting scroll 240 eccentrically coupled to the rotary shaft 226 may use the rotational force to perform an orbiting movement with respect to the fixed scroll 250.

The main bearing portion 226*c* may be inserted into and supported in the radial direction by the first bearing section 232*a* of the main frame 230. The sub-bearing portion 226*g* may be formed under the main bearing portion 226*c* to be inserted into and supported in the radial direction by the second bearing section 252 of the fixed scroll 250.

Further, the eccentric portion 226*f* inserted into and coupled to the rotary shaft coupler 242 of the orbiting scroll 240 may be formed between the main bearing portion 226*c* and the sub-bearing portion 226*g*. The main bearing portion 226*c* and the sub-bearing portion 226*g* may be formed on a same axial line to have a same axial center, and the eccentric portion 226*f* may be formed to be radially eccentric with respect to the main bearing portion 226*c* or the sub-bearing portion 226*g*.

For example, the eccentric portion 226*f* may have an outer diameter formed to be smaller than an outer diameter of the main bearing portion 226*c* and larger than an outer diameter of the sub-bearing portion 226*g*. In this case, the rotary shaft 226 may pass through and be coupled to the bearing sections 232*a* and 252 and the rotary shaft coupler 242.

The eccentric portion 226*f* may be formed using a separate bearing without being integrally formed with the rotary shaft 226. In this case, the rotary shaft 226 may be inserted into and coupled to each of the bearing sections 232*a* and 252 and the rotary shaft coupler 242 even when the outer diameter of the sub-bearing portion 226*g* is not smaller than the outer diameter of the eccentric portion 226*f*.

Further, the first oil supply path 226*a* for supplying oil stored in the oil storage chamber V4 to outer circumferential surfaces of the bearing portions 226*c* and 226*g* and an outer circumferential surface of the eccentric portion 226*f* may be formed inside of the rotary shaft 226. Also, the oil holes 226*b*, 226*d*, and 226*e* configured to pass from the first oil supply path 226*a* to the outer circumferential surface may be formed in the bearing portions 226*c* and 226*g* and the eccentric portion 226*f* of the rotary shaft 226.

Further, the oil feeder 271 that pumps oil from the oil storage chamber V4 may be coupled to a lower end of the rotary shaft 226, that is, a lower end of the sub-bearing portion 226*g*. The oil feeder 271 may include an oil supply pipe 273 inserted into and coupled to the first oil supply path 226*a* of the rotary shaft 226, and an oil suction member 274 inserted into the oil supply pipe 273 oil and configured to suction oil. The oil supply pipe 273 may pass through the through hole 276 of the discharge cover 270 and extend into the oil storage chamber V4, and the oil suction member 274 may function like a propeller.

Although not shown in drawings, a trochoid pump (not shown) may be coupled to the sub-bearing portion 226*g* instead of the oil feeder 271 to forcibly pump the oil contained in the oil storage chamber V4 upward. Also, although not shown in drawings, the scroll compressor according to an embodiment may further include a first sealing member or seal (not shown) that seals a gap between an upper end of the main bearing portion 226*c* and an upper end of the main frame 230, and a second sealing member or seal (not shown) that seals a gap between the lower end of the sub-bearing portion 226*g* and a lower end of the fixed scroll 250. For example, leakage of oil to an outside of the compression device 200 along a bearing surface may be prevented by the first and second sealing members or seals, a differential pressure oil supplying structure may be implemented, and a backflow of a refrigerant may be prevented.

A balance weight 227 to suppress noise and vibration may be coupled to the rotor 224 or the rotary shaft 226. For example, the balance weight 227 may be provided between the drive motor 220 and the compression device 200, that is, in the second space V2.

Next, a process of operating the scroll compressor 1 according to an embodiment will be described hereinafter.

The rotary shaft 226 coupled to the rotor 224 of the drive motor 220 may rotate when power is applied to the drive motor 220, and a rotational force generated. Then, the orbiting scroll 240 eccentrically coupled to the rotary shaft 226 may perform an orbiting movement with respect to the fixed scroll 250 and form the compression chamber S1 between the orbiting wrap 241 and the fixed wrap 251. The compression chamber S1 may be continuously formed over several steps such that a volume thereof gradually decreases in a central direction.

A refrigerant supplied from outside of the casing 210 through the refrigerant suction pipe 218 may directly flow into the compression chamber S1. The refrigerant may be compressed while being moved in a direction of a discharge chamber of the compression chamber S1 by the orbiting movement of the orbiting scroll 240 to be discharged from the discharge chamber into the third space V3 through the discharge path 253 of the fixed scroll 250.

A series of processes of discharging the compressed refrigerant discharged into the third space V3 to an inside of the casing 210 through the second discharge hole 256*b* and the first discharge hole 231*a* and discharging the compressed refrigerant to the outside of the casing 210 through the refrigerant discharge pipe 216 may be repeated.

Next, a flow of oil in the scroll compressor 1 according to an embodiment will be described below with reference to FIG. 3. FIG. 3 is a view illustrating a flow of oil in the scroll compressor, and some components are omitted or schematically described.

Oil stored in the oil storage chamber V4 (see FIG. 1) may be guided, that is, moved or supplied, upward through the first oil supply path 226*a* (see FIG. 1) of the rotary shaft 226. The oil guided upward may be guided to the high pressure area S3 through the oil holes 226*b*, 226*d*, and 226*e* of the first oil supply path 226*a*.

The oil guided to the high pressure area S3 may be guided to the medium pressure area S2 through the second oil supply path 283 provided in the orbiting scroll 240. The oil guided to the medium pressure area S2 may be guided to the oil groove 290 through the third oil supply path 285 or flow downward along an upper surface and side surfaces of the orbiting scroll 240 to be guided to the oil groove 290. The oil guided to the oil groove 290 may be supplied to the thrust surface of the fixed scroll 250 and may prevent wear due to friction between the fixed scroll 250 and the orbiting scroll 240 during the orbiting movement between the fixed scroll 250 and the orbiting scroll 240.

In the scroll compressor 1 of FIG. 1, a mechanism which prevents the orbiting scroll from being shaken in the axial direction by supplying high pressure oil to the thrust surface will be described hereinafter.

Figure 4:
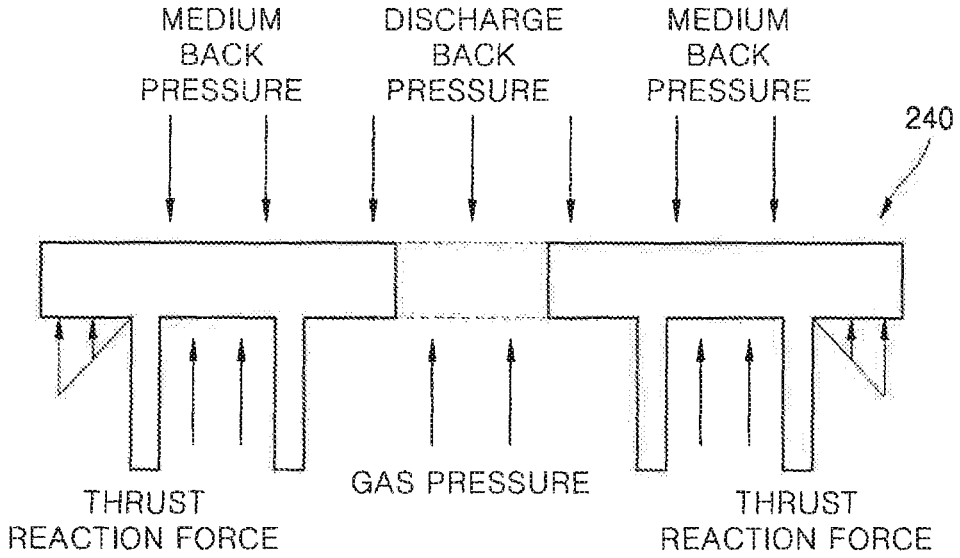
FIGS. 4 and 5 are schematic views for describing a conventional mechanism of an orbiting scroll shaken in an axial direction due to an overturn moment generated by a gas pressure.
Figure 5:
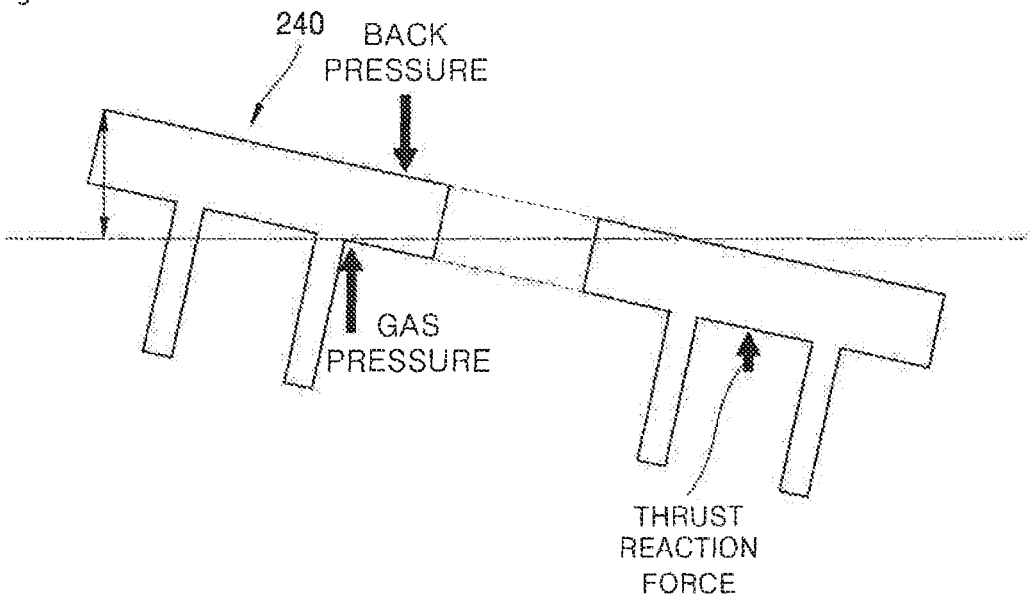
Figure 6:
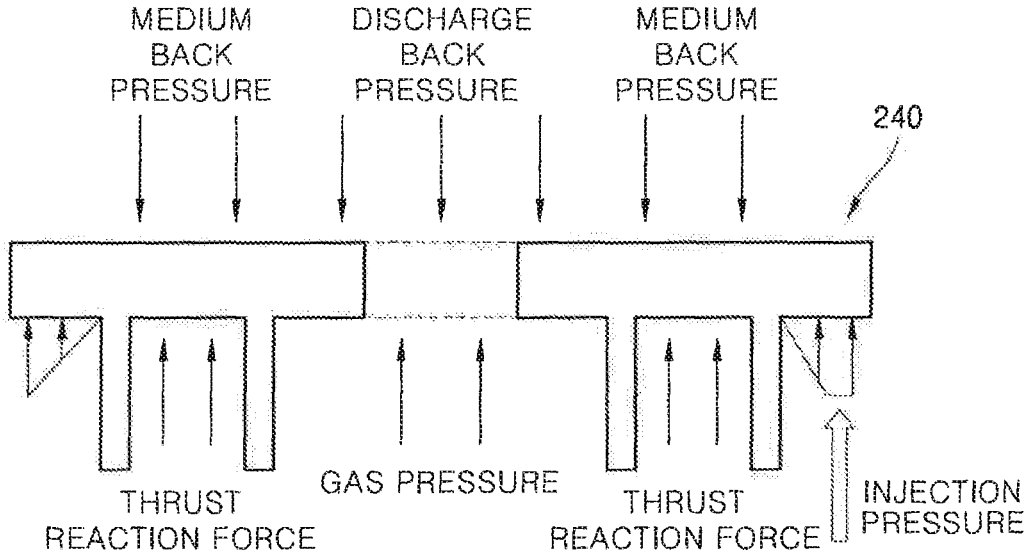
FIGS. 6 and 7 are schematic views for describing a mechanism in which the overturn moment generated by the gas pressure is offset to prevent the orbiting scroll from being shaken in the axial direction of the scroll compressor in FIG. 1.
Figure 7:
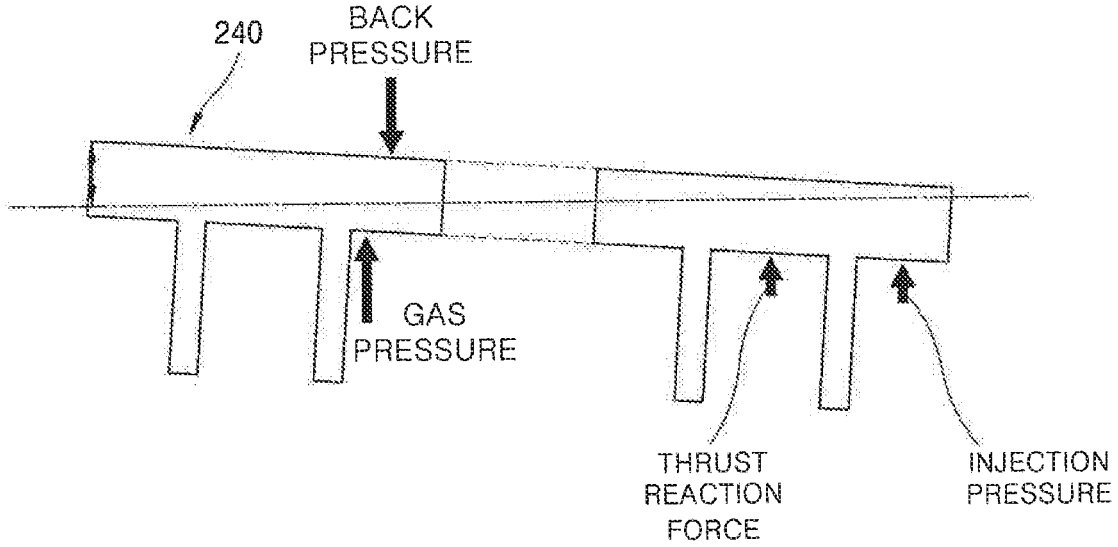

FIGS. 4 and 5 are schematic views for describing a conventional mechanism of an orbiting scroll shaken in an axial direction due to an overturn moment generated by a gas pressure. FIGS. 6 and 7 are schematic views for describing a mechanism which offsets the overturn moment generated by the gas pressure to prevent the orbiting scroll from being shaken in the axial direction of the scroll compressor in FIG. 1.

First, referring to FIGS. 4 and 5, a gas pressure and a thrust reaction force act on the orbiting scroll 240 in an upward direction in a conventional scroll compressor. Also, a medium back pressure and a discharge back pressure act on the orbiting scroll 240 in a downward direction due to reaction forces opposing the gas pressure and the thrust reaction force.

The thrust reaction force may be a reaction force caused by friction between a thrust surface of a fixed scroll and the orbiting scroll 240, the medium back pressure may be a back pressure of a medium pressure area, and the discharge back pressure may be a back pressure generated when a refrigerant is discharged. That is, when a repulsive force, that is, a gas pressure, of a refrigerant acts on the orbiting scroll 240 in the upward direction in a compression chamber, a compressive force, that is, a back pressure, is applied in the downward direction to the orbiting scroll 240 in a back pressure chamber due to a reaction force opposing the repulsive force during a compression operation of the scroll compressor.

However, as illustrated in FIG. 5, when the gas pressure is concentrated in and strongly acts on or at a specific point or a point on or at which the gas pressure acts is radially separated from a point on or at which the back pressure acts, an overturn moment may be generated in the orbiting scroll 240. Also, the orbiting scroll 240 may be inclined or shaken thereof in the axial direction may be increased due to the overturn moment.

However, referring to FIGS. 1, 6, and 7, the gas pressure, the thrust reaction force, and the injection pressure may act on the orbiting scroll 240 in the upward direction in the scroll compressor 1 according to an embodiment. Also, the medium back pressure and the discharge back pressure may act on the orbiting scroll 240 in the downward direction due to reaction forces opposing the gas pressure, the thrust reaction force, and the injection pressure. The injection pressure may be a pressure generated when high pressure oil is supplied to the thrust surface of the fixed scroll 250.

As illustrated in FIG. 6, a profile of the thrust reaction force acting on the orbiting scroll 240 may be changed due to the oil supplied to the thrust surface of the fixed scroll 250. Also, an injection pressure acting on the orbiting scroll 240 in a same direction as a direction of the thrust reaction force may be added thereto.

Accordingly, as illustrated in FIG. 7, although the overturn moment is generated in the orbiting scroll 240 in which the gas pressure is concentrated in and strongly acts on or at the specific point or the point on or at which the gas pressure acts is radially separated from the point on or at which the back pressure acts, the overturn moment may be offset by the injection pressure. Accordingly, the orbiting scroll 240 may be prevented from being inclined or being shaken in the axial direction. Although the orbiting scroll 240 may be slightly inclined or shaken in the axial direction, a degree of inclination or shake in the axial direction may be reduced in comparison to a conventional case.

As described above, the scroll compressor 1 according to an embodiment may supply oil to the thrust surface of the fixed scroll 250 through the oil groove 290 to prevent over-wear of the fixed scroll 250 or the orbiting scroll 240. Further, mechanical loss and reduction of compression efficiency of the scroll compressor 1 due to over-wear of the fixed scroll 250 or the orbiting scroll 240 may be reduced.

Also, the scroll compressor 1 according to an embodiment may offset an overturn moment generated in the orbiting scroll 240 due to the gas pressure by supplying oil to the thrust surface of the fixed scroll 250. Further, the scroll compressor 1 may prevent the orbiting scroll 240 from being inclined or moving in the axial direction due to the overturn moment generated by the gas pressure, thereby a compression efficiency of the scroll compressor 1 may be improved.

Embodiments disclosed herein are directed to a scroll compressor capable of preventing over-wear of a fixed scroll or an orbiting scroll by smoothly supplying oil to a thrust surface of the fixed scroll. Embodiments disclosed herein are also directed to a scroll compressor capable of preventing an orbiting scroll from being inclined or moving in an axial direction by offsetting an overturn moment generated in the orbiting scroll due to a gas pressure.

A scroll compressor according to embodiments disclosed herein may smoothly supply oil to a thrust surface of a fixed scroll by including a fixed scroll having an oil groove formed in a thrust surface of a fixed scroll sidewall. The scroll compressor according to embodiments disclosed herein may add an injection pressure acting on an orbiting scroll in an upward direction by supplying oil guided to the oil groove to the thrust surface of the fixed scroll so that an overturn moment generated in an orbiting scroll may be offset.

This application relates to U.S. application Ser. No. 15/830,135, U.S. application Ser. No. 15/830,161, U.S. application Ser. No. 15/830,222, U.S. application Ser. No. 15/830,248, and U.S. application Ser. No. 15/830,290, all filed on Dec. 4, 2017, which are hereby incorporated by reference in their entirety. Further, one of ordinary skill in the art will recognize that features disclosed in these above-noted applications may be combined in any combination with features disclosed herein.

While embodiments have been described for those skilled in the art, it should be understood that embodiments may be replaced, modified, and changed without departing from the technical spirit, and thus, embodiments are not limited to the above-described embodiments and the accompanying drawings.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing configured to store oil in an oil storage chamber at a lower portion thereof;

a drive motor provided inside of the casing;

a rotary shaft coupled to the drive motor and having a first oil supply path through which the oil stored in the oil storage chamber of the casing is guided upward;

a main frame provided under the drive motor;

a fixed scroll provided under the main frame and having a fixed scroll end plate, a fixed scroll sidewall that protrudes upward from an outer circumferential portion of the fixed scroll end plate, and a fixed wrap configured to protrude from an upper surface of the fixed scroll end plate, wherein at least one oil groove is formed in a thrust surface of the fixed scroll sidewall; and an orbiting scroll provided between the main frame and the fixed scroll and having an orbiting scroll end plate having a rotary shaft coupler coupled to the rotary shaft, which passes through the rotary shaft coupler, and an orbiting wrap engaged with the fixed wrap to form a compression chamber, wherein the at least one oil groove includes:

at least one first oil groove formed in the thrust surface along an outer circumferential surface of the fixed scroll sidewall; and at least one second oil groove formed in the thrust surface between the at least one first oil groove and the fixed wrap, wherein the oil guided upward through the first oil supply path sequentially passes through a high pressure area formed between the main frame and the orbiting scroll and a medium pressure area and is guided to the at least one oil groove, wherein a second oil supply path configured to guide the oil, which is guided to the high pressure area through the first oil supply path, to the medium pressure area is provided in the orbiting scroll end plate, and wherein the oil guided to the medium pressure area is guided to the at least one oil groove to be supplied to the thrust surface of the fixed scroll.

2. The scroll compressor of claim 1, further including a back pressure seal provided between the main frame and the orbiting scroll to divide the high pressure area and the medium pressure area.

3. The scroll compressor of claim 1, wherein each of the high pressure area and the medium pressure area is separated from the rotary shaft in a radial direction.

4. A scroll compressor, comprising:

a casing configured to store oil in an oil storage chamber at a lower portion thereof;

a drive motor provided inside of the casing;

a rotary shaft coupled to the drive motor and having a first oil supply path through which the oil stored in the oil storage chamber of the casing is guided upward;

a main frame provided under the drive motor;

a fixed scroll provided under the main frame and having a fixed scroll end plate, a fixed scroll sidewall formed that protrudes upward from an outer circumferential portion of the fixed scroll end plate, and a fixed wrap configured to protrude from an upper surface of the fixed scroll end plate, wherein at least one oil groove is formed in a thrust surface of the fixed scroll sidewall; and an orbiting scroll provided between the main frame and the fixed scroll and having an orbiting scroll end plate having a rotary shaft coupler coupled to the rotary shaft, which passes through the rotary shaft coupler, and an orbiting wrap engaged with the fixed wrap to form a compression chamber, wherein the at least one oil groove includes:

at least one first oil groove formed in a ring shape in the thrust surface along an outer circumferential surface of the fixed scroll sidewall; and at least one second oil groove formed in the thrust surface between the first oil groove and the fixed wrap, wherein the oil guided upward through the first oil supply path sequentially passes through a high pressure area formed between the main frame and the orbiting scroll and a medium pressure area and is guided to the at least one oil groove, wherein the oil guided to the at least one oil groove is supplied to the thrust surface of the fixed scroll, wherein a profile of a thrust reaction force acting on the orbiting scroll is changed by the oil supplied to the thrust surface of the fixed scroll, and wherein an injection pressure acting on the orbiting scroll is added to the thrust reaction force in a same direction as the thrust reaction force.

5. The scroll compressor of claim 4, wherein a gas pressure, the thrust reaction force, and the injection pressure act on the orbiting scroll in an upward direction, wherein a medium back pressure and a discharge back pressure act on the orbiting scroll in a downward direction due to reaction forces opposing the gas pressure, the thrust reaction force, and the injection pressure, and wherein the injection pressure offsets an overturn moment generated in the orbiting scroll due to the gas pressure.

6. The scroll compressor of claim 4, wherein an upper surface of the fixed scroll sidewall includes the thrust surface.

7. The scroll compressor of claim 4, wherein the at least one second oil groove is formed in the thrust surface adjacent to a starting point of the fixed wrap, and wherein the starting point of the fixed wrap is a point separated farther from the rotary shaft in a radial direction than an ending point of the fixed wrap.

8. A scroll compressor, comprising:

a casing;

a drive motor having a stator fixed inside of the casing and a rotor rotatably provided inside of the stator;

a rotary shaft coupled to the rotor and configured to rotate with the rotor;

a compression device having a main frame disposed under the drive motor, a fixed scroll provided under the main frame and having at least one oil groove formed in a thrust surface thereof, and an orbiting scroll provided between the fixed scroll and the main frame and engaged with the fixed scroll to form a compression chamber; and an oil storage chamber provided inside of the casing, wherein oil guided upward from the oil storage chamber through a first oil supply path provided in the rotary shaft is guided to the at least one oil groove through a second oil supply path provided in the compression device, wherein the at least one oil groove includes:

a ring shaped oil groove formed in the thrust surface along an outer circumferential surface of the fixed scroll; and an auxiliary oil groove formed in the thrust surface between the ring shaped oil groove and the rotary shaft, wherein a high pressure area and a medium pressure area are formed between the main frame and the orbiting scroll; wherein the oil guided upward from the oil storage chamber through the first oil supply path provided in the rotary shaft is guided to the high pressure area through the first oil supply path; wherein the oil guided to the high pressure area is guided to the medium pressure area through the second oil supply path; and wherein the oil guided to the medium pressure area is guided to the ring shaped oil groove and the auxiliary oil groove to be supplied to the thrust surface of the fixed scroll.

9. The scroll compressor of claim 8, wherein a back pressure seal is provided between the main frame and the orbiting scroll of the compression device to divide the high pressure area and the medium pressure area.

10. The scroll compressor of claim 8, wherein the orbiting scroll comprises an orbiting scroll end plate having a rotary shaft coupler coupled to the rotary shaft, which passes through the rotary shaft coupler, and wherein the second oil supply path is provided in the orbiting scroll end plate.

11. The scroll compressor of claim 8, wherein the auxiliary oil groove is formed in the thrust surface adjacent to a starting point of a fixed wrap of the fixed scroll, and wherein the starting point of the fixed wrap is a point separated farther from the rotary shaft in a radial direction than an ending point of the fixed wrap.

12. A scroll compressor, comprising:

a main frame;

a fixed scroll provided under the main frame and having a fixed scroll end plate, a fixed scroll sidewall that protrudes upward from an outer circumferential portion of the fixed scroll end plate, and a fixed wrap configured to protrude from an upper surface of the fixed scroll end plate, wherein at least one oil groove is formed in a thrust surface of the fixed scroll sidewall; and an orbiting scroll provided between the main frame and the fixed scroll and having an orbiting scroll end plate having a rotary shaft coupler into which the rotary shaft is inserted and to which the rotary shaft is eccentrically coupled, and an orbiting wrap that protrudes from the orbiting scroll end plate and engaged with the fixed wrap to form a compression chamber, wherein oil guided upward from an oil storage chamber through a first oil supply path provided in the rotary shaft sequentially passes through the main frame and the orbiting scroll and is guided to the at least one oil groove, and wherein the at least one oil groove includes:

at least one first oil groove formed in a ring shape in the thrust surface along an outer circumferential surface of the fixed scroll sidewall; and at least one second oil groove formed in the thrust surface between the first oil groove and the fixed wrap, wherein a second oil supply path configured to guide the oil, which is guided to a high pressure area through the first oil supply path, to a medium pressure area is provided in the orbiting scroll end plate, and wherein the oil guided to the medium pressure area is guided to the at least one oil groove to be supplied to the thrust surface of the fixed scroll.

13. The scroll compressor of claim 12, wherein a back pressure seal is provided between the main frame and the orbiting scroll to divide the high pressure area and the medium pressure area.

14. The scroll compressor of claim 12, wherein the at least one second oil groove is formed in the thrust surface adjacent to a starting point of the fixed wrap, and wherein the starting point of the fixed wrap is a point separated farther from the rotary shaft in a radial direction than an ending point of the fixed wrap.

15. A scroll compressor, comprising:

a casing configured to store oil in an oil storage chamber at an inner space thereof;

a drive motor provided inside of the casing;

a rotary shaft coupled to the drive motor and having a first oil supply path through which the oil stored in the oil storage chamber of the casing is guided upward;

a main frame provided at one side of the drive motor;

a fixed scroll provided at one side of the main frame and having at least one oil groove formed in a thrust surface thereof;

and an orbiting scroll provided between the main frame and the fixed scroll and engaged with the fixed scroll and performing an orbiting movement to form a compression chamber, wherein the oil guided upward through the first oil supply path is guided to the at least one oil groove through the main frame and the orbiting scroll, and wherein the at least one oil groove includes:

at least one first oil groove formed in the thrust surface along an outer circumferential surface of a fixed scroll sidewall of the fixed scroll; and at least one second oil groove formed in the thrust surface between the at least one first oil groove and a fixed wrap protruding from an upper surface of a fixed scroll end plate of the fixed scroll, wherein the oil guided upward through the first oil supply path sequentially passes through a high pressure area formed between the main frame and the orbiting scroll and a medium pressure area and is guided to the at least one oil groove, wherein the oil guided to the at least one oil groove is supplied to the thrust surface of the fixed scroll, wherein a profile of a thrust reaction force acting on the orbiting scroll is changed by the oil supplied to the thrust surface of the fixed scroll, and wherein an injection pressure acting on the orbiting scroll is added to the thrust reaction force in a same direction as the thrust reaction force.

16. The scroll compressor of claim 15, wherein the at least one second oil groove is formed in the thrust surface adjacent to a starting point of a fixed wrap of the fixed scroll, and wherein the starting point of the fixed wrap is a point separated farther from the rotary shaft in a radial direction than an ending point of the fixed wrap.

* * * * *